US009328437B2

(12) United States Patent
Mueller et al.

(10) Patent No.: US 9,328,437 B2
(45) Date of Patent: May 3, 2016

(54) DEVICE FOR THE INTERMEDIATE STORAGE OF BAND-LIKE WEFT MATERIAL FOR A WEAVING MACHINE AND WEAVING MACHINE HAVING SUCH A DEVICE

(71) Applicant: Lindauer DORNIER GmbH, Lindau (DE)

(72) Inventors: Herbert Mueller, Pineville, NC (US); Thomas Laukamp, Lindau (DE); Dirk Janicijevic, Lindau (DE); Johannes Louven, Kerken (DE); Nicolas Mega, Opfenbach (DE); Michael Langer, Hergensweiler (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 0 days.

(21) Appl. No.: 14/413,733

(22) PCT Filed: Jun. 5, 2013

(86) PCT No.: PCT/EP2013/061563
§ 371 (c)(1),
(2) Date: Jan. 9, 2015

(87) PCT Pub. No.: WO2014/009063
PCT Pub. Date: Jan. 16, 2014

(65) Prior Publication Data

US 2015/0203999 A1 Jul. 23, 2015

(30) Foreign Application Priority Data

Jul. 11, 2012 (DE) ..... 10 2012 212 169

(51) Int. Cl.
*D03D 47/34* (2006.01)
*D03D 47/36* (2006.01)

(Continued)

(52) U.S. Cl.
CPC ..... *D03D 47/363* (2013.01); *D03D 41/008* (2013.01); *D03D 47/34* (2013.01); *D03D 47/36* (2013.01)

(58) Field of Classification Search
CPC ..... D03D 15/0088; D03D 41/008; D03D 13/002; D03D 15/00; D03D 15/0077; D03D 41/00; D03D 47/277; D03D 47/36; D03D 13/00; D03D 2700/1459; D03D 47/00; D03D 47/34; D03D 47/368
See application file for complete search history.

(56) References Cited

U.S. PATENT DOCUMENTS 3,575,217 A * 4/1971 Pfarrwaller ..... D03D 47/00 139/452

(Continued)

FOREIGN PATENT DOCUMENTS

DE 103 15 347 10/2004
DE 102009036589 2/2011

(Continued)

OTHER PUBLICATIONS

International Search Report of the International Searching Authority for International Application PCT/EP2013/061563, mailed Jul. 19, 2013, 2 pages, European Patent Office, HV Rijswijk, Netherlands.

(Continued)

*Primary Examiner* — Bobby Muromoto, Jr.
(74) *Attorney, Agent, or Firm* — W. F. Fasse

(57) ABSTRACT

Apparatus for the intermediate storage of two band-like weft materials (1, 21) for a weaving machine (3), with two storage containers (7, 27) in which respectively a U-shaped loop (12, 22) of a weft material (1, 21) can be formed. Machine elements (14, 34) for the application of tensile forces (15, 35) onto the weft material (1, 21) in the inner space (9, 29) of the respective storage container (7, 27) are present. The inner spaces (9, 29) of the two storage containers (7, 27) respectively orient one of their two narrow sides (10, 30) toward one another. Deflection elements (16, 36) are respectively arranged on the storage container (7, 27) in such a manner so that the respective weft material (1, 21) can be supplied to the inner space (9, 29) in a region (17, 37) that lies closer to that one of the two narrow sides (11, 31) of this inner space (9, 29), which is not oriented toward the inner space (9, 29) of the respective other storage container (7, 27).

8 Claims, 5 Drawing Sheets

(51) Int. Cl.
*D03D 41/00* (2006.01)
*D03D 47/00* (2006.01)

(56) References Cited

U.S. PATENT DOCUMENTS

| | | | | | |
|---|---|---|---|---|---|
| 3,580,444 | A * | 5/1971 | Van Mullekom | D03D 47/36 | 139/435.1 |
| 3,587,661 | A | 6/1971 | Golobart | | |
| 3,596,683 | A * | 8/1971 | Dendo | D03D 47/00 | 139/452 |
| 3,669,328 | A * | 6/1972 | Castelli | B65H 51/16 | 139/452 |
| 3,731,713 | A * | 5/1973 | Lachapelle | D03D 47/00 | 139/452 |
| 3,799,212 | A * | 3/1974 | Stanislav | D03D 47/00 | 139/452 |
| 3,825,198 | A * | 7/1974 | Oehninger | D03D 47/00 | 139/452 |
| 3,918,501 | A * | 11/1975 | Wolstencroft | D03D 41/008 | 139/435.1 |
| 4,031,928 | A * | 6/1977 | Gunneman | D03D 47/00 | 139/452 |
| 4,252,156 | A * | 2/1981 | Brown, Jr. | D03D 47/276 | 139/449 |
| 4,274,449 | A * | 6/1981 | Freisler | D03D 47/276 | 139/449 |
| 4,371,009 | A * | 2/1983 | Simson | D03D 47/34 | 139/452 |
| 4,771,815 | A * | 9/1988 | Tamaro | D03D 47/276 | 139/449 |
| 5,455,107 | A | 10/1995 | Homma et al. | | |
| 6,367,513 | B1 * | 4/2002 | Cain | D03D 15/00 | 139/383 R |
| 6,450,208 | B1 | 9/2002 | Khokar | | |
| 6,494,235 | B1 | 12/2002 | Bruyere et al. | | |
| 7,992,596 | B2 * | 8/2011 | Khokar | D03D 1/0052 | 139/383 R |
| 8,129,294 | B2 * | 3/2012 | Khokar | D02G 3/06 | 442/185 |
| 8,550,123 | B2 * | 10/2013 | Laukamp | D03D 41/008 | 139/116.1 |
| 8,656,962 | B2 | 2/2014 | Oppl | | |
| 8,939,179 | B2 | 1/2015 | Janicijevic et al. | | |
| 9,169,584 | B2 * | 10/2015 | Khokar | D03D 41/008 | |
| 2009/0007981 | A1 * | 1/2009 | Khokar | D02G 3/06 | 139/383 A |
| 2014/0272227 | A1 * | 9/2014 | Jeltsch | B32B 5/26 | 428/36.4 |

FOREIGN PATENT DOCUMENTS

| | | |
|---|---|---|
| EP | 0 277 668 | 8/1988 |
| EP | 1 838 911 | 10/2007 |
| GB | 2 072 718 | 10/1981 |
| JP | 2001-329452 A | 11/2001 |

OTHER PUBLICATIONS

English Translation of PCT Written Opinion of the International Searching Authority for International Application PCT/EP2013/061563, mailed Jul. 19, 2013, 6 pages, European Patent Office, HV Rijswijk, Netherlands.

* cited by examiner

DEVICE FOR THE INTERMEDIATE STORAGE OF BAND-LIKE WEFT MATERIAL FOR A WEAVING MACHINE AND WEAVING MACHINE HAVING SUCH A DEVICE

TECHNICAL FIELD

The present invention relates to a device or apparatus for the intermediate storage of band-like weft material for a weaving machine.

STATE OF THE ART

In connection with weaving machines, various different devices or apparatuses for supplying and intermediately storing a band-like weft material are known in the state of the art. For example, the EP 1838911 A1 shows a weaving machine for the processing of band-like weft material. Therein, a device for supplying the band-like weft material to a weft insertion element is also disclosed. The weft material is intermittently drawn-off from one or more driven supply spools or bobbins at each weft insertion cycle of the weaving machine. The device according to EP 1838911 A1, however, has the disadvantage that the supply bobbins must be accelerated and braked in a very short time at higher drawing-off or unwinding speeds. It is thus usual to provide intermediate storage devices for the weft material.

A device suitable for this purpose is shown for example by the DE 103 15 347 A1. This relates to the intermediate storage of fibers that are drawn-off discontinuously from a supply bobbin and delivered to a production line. Weaving is given as an example for such a production line.

A similar device is shown also by the JP 2001329452 A.

However, in the DE 103 15 347 A1 and in the JP 2001329452 A, the intermediate storage devices are arranged in such a manner so that during the drawing-off or unwinding, the weft material is deflected around 90° between the loop in the storage container and the production line in the weaving machine. Deflections are, however, damaging for some weft materials. Band-like weft materials made of carbon fibers, for example, should be deflected as little as possible in the production process, because at each deflection the very brittle carbon fibers are in danger of breaking and because the composite or combination of the band-like weft material made of many individual fibers can come apart in an undesired manner during the deflection.

Moreover, for the production process on weaving machines it is in principle sensible to draw-off or unwind the weft material from two different supply bobbins, even if it involves the same material in that regard. If one of the two supply bobbins runs empty, then the machine can continue operating without interruption, while the empty supply bobbin is exchanged by a full bobbin.

A device for selecting band-like weft materials from two different thread supplies is disclosed in the DE 10 2009 036 589 A1. The EP 1838911 A1 also shows two supply bobbins, from which band-like weft material is unrolled and delivered to a loom shed. Devices for intermediately storing the two weft materials are not disclosed in the EP 1838911 A1 and in the DE 10 2009 036 589 A1.

Thus, from the state of the art it is not known how the supply of weft material from an electrically driven supply bobbin via an intermediate storage device to a weaving machine is to be achieved, if sensitive band-like weft material is to be drawn-off or unwound from two different supply bobbins and inserted.

It is an object of the present invention to produce a device for the intermediate storage of band-like weft material for a weaving machine, whereby deflections of the weft material on the path to the weaving machine are reduced by the device.

DESCRIPTION OF THE INVENTION

The object is achieved by a device according to the independent claim.

This device serves for the intermediate storage of two band-like weft materials for a weaving machine. In this regard, the term band-like weft material means a flexible material of which the width is greater by a multiple than its thickness. In that regard, it can involve a homogeneous material or a composite or combination of many individual fibers.

Generally, the first and the second weft material are respectively stored on a first and a second supply bobbin, which are respectively drivable about a rotation axis with the aid of a first or second drive arrangement. The device comprises a first storage container with an opening for the first weft material. This opening can be embodied so that thereby weft material can be supplied to the storage container and also can be removed out of the storage container. Arrangements are also conceivable, in which the storage container, instead of a single opening, comprises a lid that has two openings. One of those can then be used for the supply or delivery of weft material to the storage container, while the other serves for the removal of the weft material.

The first storage container comprises an inner space that is bounded by two narrow sides. These two narrow sides extend in the longitudinal direction of the first storage container. Furthermore, these narrow sides are embodied so that a U-shaped loop of the first weft material can be formed between them. That means that the diameter of the U-shaped loop of the weft material to be formed is bounded or limited by the narrow sides. In that regard, it is of no significance whether the narrow sides involve closed solid walls or merely limiting or bounding elements of the inner space, which are arranged in such a manner so that an exiting of the U-shaped loop out of the inner space is prevented.

Furthermore, means for applying a first tensile force onto the first weft material are present. This can, for example, be a reduced pressure or vacuum arrangement or a springing element, with which a tensile force is exertable on a loop of the weft material. This tensile force is oriented or directed in the longitudinal direction of the first storage container from the opening for the first weft material inwardly into the inner space of the first storage container.

The device further comprises a first deflection element, which is arranged in such a manner so that the first weft material can be supplied over the first deflection element through the opening for the first weft material into the inner space of the first storage container. In that regard, the first deflection element can, for example, be embodied as a deflection roller or in an otherwise suitable form. Generally, the first deflection element is mounted or arranged between the first supply bobbin and the first storage container.

According to the invention, the device is characterized by a second storage container with an opening for the second weft material. Regarding the possible arrangement of the openings, analogously the same pertains as for the openings of the first storage container.

The second storage container comprises an inner space that is bounded or limited by two narrow sides in such a manner so that a U-shaped loop of the second weft material can be formed between these narrow sides. The two narrow sides of the second storage container extend in the longitudinal direction of the second storage container.

Furthermore, means for applying a second tensile force onto the second weft material are present, whereby the second tensile force is oriented or directed in the longitudinal direction of the second storage container from the opening for the second weft material into the inner space of the second storage container.

Furthermore, a second deflection element is present, which is arranged in such a manner so that the second weft material can be supplied via the second deflection element through the opening into the inner space of the second storage container. Generally, the second deflection element is mounted or arranged between the second supply bobbin and the second storage container.

According to the invention, both storage containers are arranged in such a manner so that the two weft materials can be supplied from the same direction through the respective openings to the storage containers. Such an arrangement arises if the openings of the storage containers are oriented in the same direction with respect to the overall device. Then the weft materials can also again be removed in this direction through the respective openings.

Moreover, the arrangement is selected according to the invention in such a manner so that the inner spaces of the two storage containers respectively face or orient one of the two narrow sides toward one another.

Finally, the narrow sides of the two inner spaces lie parallel to one another at least in their width extension. Thereby it is achieved that the two band-like weft materials extend parallel to one another in the width direction of the weft material.

According to the invention it is further provided that the two deflection elements are respectively arranged in such a manner so that the respective weft material can be supplied through the opening for this weft material to the inner space of the respective storage container in an area or region, which, with respect to the two narrow sides of this inner space, lies closer to that one of the two narrow sides of this inner space, which does not face or is not oriented toward the inner space of the respective other storage container.

The arrangement according to the invention is especially advantageous because it is not possible to arrange two devices for the supply of weft material according to DE 103 15 347 A1 or JP 2001329452 A simply next to the weaving machine one behind another in the warp direction. Such arrangements would merely be suitable for normal weft thread or yarn, which is not embodied band-like, because with such a weft yarn a deflection in all directions perpendicularly to the extension of the weft yarn can be permitted. However, with sensitive band-like weft material, deflections in the direction of the width extension of the band are in principle not possible, because the band would thereby be damaged or twisted. However, in a weaving machine the width extension of a band-like weft material generally extends in the warp direction. The necessary supply and intermediate storage devices cannot be arranged one behind another in the warp direction, because at least for one of the two weft materials a deflection in the width extension direction of the band would become necessary in order to bring this band into the motion line of the weft insertion element on the weaving machine. In this regard, the device according to the invention achieves a remedy.

In the apparatus or device according to the invention, both storage containers can be embodied, for example, as elongated hollow bodies. In this regard, the longitudinal axes of the storage containers extend essentially in the direction of the tensile forces. The inner space can comprise a rectangular or square inner cross-section. In that regard, the shorter symmetry axis of this inner cross-section can have approximately the length of the width extension of the band-like weft material that is to be stored. In this case, in operation the device is provided with band-like weft material in such a manner so that the width extension of the band extends parallel to the shorter symmetry axis of the inner cross-section.

The length of the longer symmetry axis of such a rectangular or square inner cross-section thereby corresponds to the spacing distance of the narrow sides of the inner space. This spacing distance determines the radius of curvature with which the weft material is deflected in a U-shape. in the storage container. A larger spacing distance requires more space, but protects or gently treats the weft material at the deflection point in the storage container. With such an arrangement it is possible to draw-off or unwind band-like weft material from two different supply bobbins and supply it to a weaving machine, without thereby deflections in the direction of the width extension of the band becoming necessary.

Very small deflections on the path to the weaving machine can be achieved, for example in that guide elements for the weft material are provided, which are arranged or adjusted in such a manner so that the respective weft material is removed from the associated storage container, with respect to the narrow sides, out of an area or region of the applicable inner space that respectively lies closer to that narrow side that is oriented or faces toward the respective other storage container. In that regard, existing or additional deflection elements or the sidewalls of the inner space can serve as guide elements. However, separate guide elements can also be provided for the purpose described here. Thereby, both weft materials are removed out of the device close together to one another.

Moreover, it is especially advantageous if the device comprises one or more guide elements which are arranged in such a manner and/or adjustable in such a manner so that the two weft materials are guided at least at the outlet, i.e. during the removing out of the device, in such a manner so that a symmetry line, which extends at half the width of the first weft material perpendicular to its surface, lies in a plane with a symmetry line that extends at half the width of the second weft material perpendicular to its surface. That means that the two symmetry lines of the two weft materials lie in one plane. Thereby the low-deflection supply to a weft insertion element of a weaving machine is further advantageously influenced. Existing or additional elements or the sidewalls of the inner space can serve as guide elements also for this purpose, if they are correspondingly embodied or arranged.

In connection with driven supply bobbins for the weft material, a simply constructed, symmetrical arrangement of the device arises, for example, when the rotation axes, about which the two supply bobbins are respectively drivable, are arranged in such a manner so that the planes in which the narrow sides of the two inner spaces extend, lie between the rotation axes. That means that the storage containers, for example, lie in the middle in the intermediate space between the rotation axes of the two supply bobbins. However, other, also unsymmetrical, arrangements of the rotation axes are also conceivable (e.g. in front of or behind, over or under the storage containers) which, however, then can make additional deflections necessary.

In that regard it is suitable or appropriate if the narrow sides of the inner spaces of the storage containers extend with their width extension parallel to the direction of the rotation axes of the supply bobbins, because then a twist-free running of the weft material between supply bobbins and inner spaces is possible.

Especially advantageous is an arrangement of storage containers and deflection elements that is constructed partially or completely in a mirror image manner or mirror symmetrical to a center line facing in the longitudinal direction and lying in the middle between the two storage containers. This mirror image or symmetrical construction makes it possible to remove the two weft materials out of the device near the center line and supply them to a weaving machine, without giving rise to further deflections of the weft materials.

In this arrangement it arises that all four narrow sides of the two inner spaces lie in planes that extend parallel to one another.

It is furthermore structurally advantageous to embody the device so that a separating wall is present between the two inner spaces, which separating wall is common to both storage containers. Thereby, this separating wall contains the above described center line of the two storage containers. Such an arrangement results in smallest possible deflections and is especially space-saving.

The storage containers can, for example, be embodied as storage shafts with openings for the weft material at respectively one of the shaft ends. In that regard it is advantageous if the openings of the two storage shafts lie in one plane.

The device can further be equipped with a reduced pressure or vacuum device for exerting the tensile forces on the two weft materials. The reduced pressure or vacuum device is thereby, for example, embodied so that therewith a reduced pressure or vacuum can be produced selectively in the first or in the second or in both storage containers. For that, a switch-over arrangement is utilized.

In this manner in operation it is possible to impose a reduced pressure or vacuum on both storage containers alternately or simultaneously with a single reduced pressure or vacuum device, for example a vacuum pump. Moreover, during maintenance work on one of the storage containers, this storage container can be separated from the reduced pressure or vacuum system through the switch-over possibility.

However, it is also conceivable to use respectively one reduced pressure or vacuum device for respectively one storage container, whereby also therewith the above described alternating manner of operation and possibly also different reduced pressures in the two storage containers are possible.

Alternatively to the reduced pressure or vacuum device, however, the tensile force can also be exerted by a spring device, which exerts a tensile force onto the weft material via a movable deflection element. In that regard, the one end of a spring is connected with the storage container and the other with the movable deflection element.

It is especially advantageous to arrange the two storage containers of the device for the intermediate storage of the two band-like weft materials on a weaving machine in such a manner so that the two tensile forces extend parallel to a weft direction of the weaving machine. Therewith, the weft material can thus be supplied from the storage container out to the weft insertion element without a deflection about 90°.

Moreover, the two inner spaces of the storage container can be arranged symmetrically to a line that extends essentially in extension of a movement line of a weft insertion element of the weaving machine. Thereby it is achieved that both weft materials, beginning from the respective storage containers, must be deflected by respectively the same amount, in order to come into the movement line of the weft insertion element.

For the processing of two band-like weft materials, which are to be inserted in alternation on the weaving machine, it is especially advantageous if a selection apparatus or device is provided on the weaving machine in addition to and together with the device for the intermediate storage of the two band-like weft materials, whereby this selection device is arranged between the openings of the two storage containers for the two weft materials and the inlet of a loom shed of the weaving machine, and with which selection device the first or the second weft material can be selectively supplied to the weft insertion element of the weaving machine.

ADVANTAGEOUS EMBODIMENTS OF THE INVENTION

Figure 1:
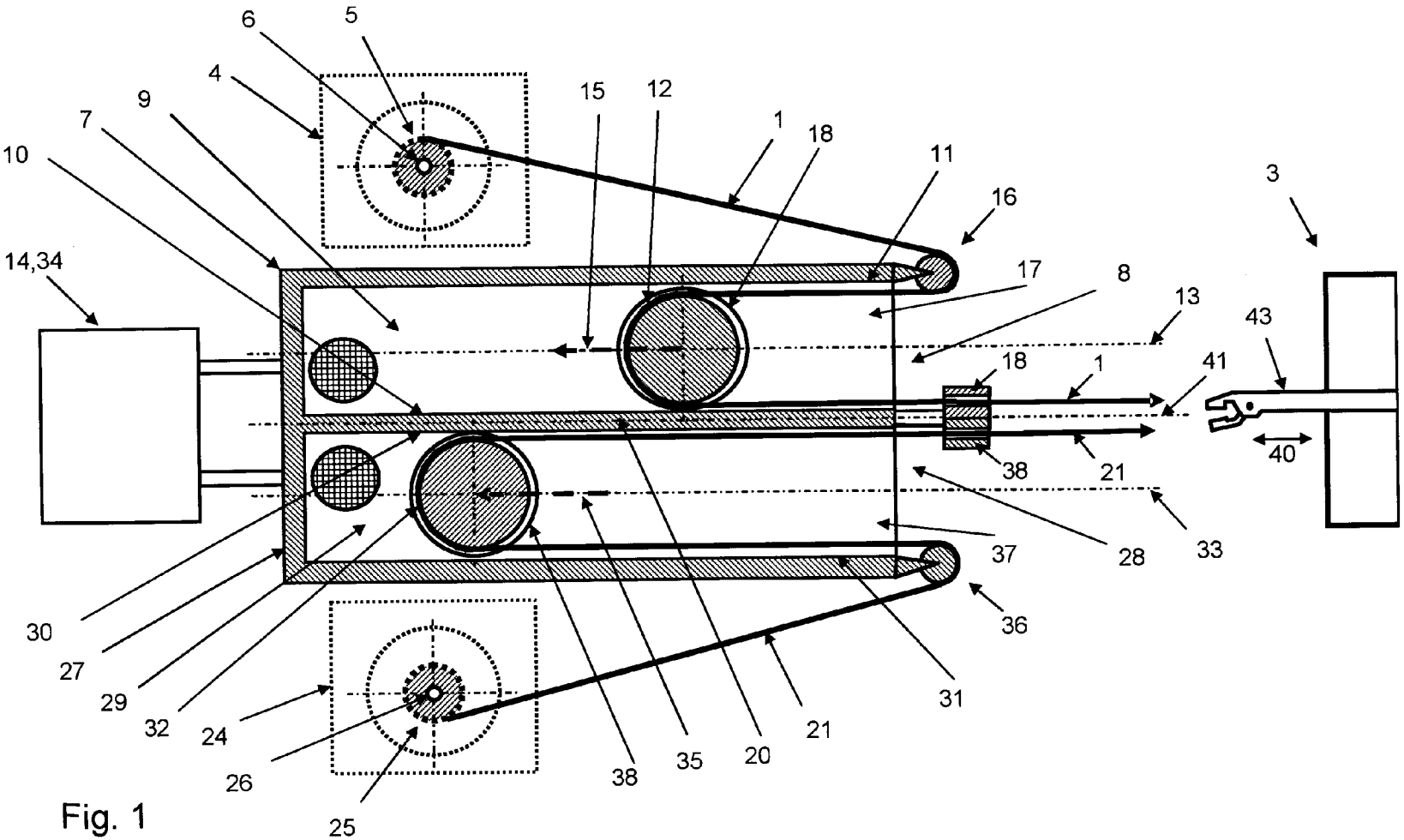
FIG. 1 Schematic illustration of an embodiment of the device according to the invention in section.
Figure 2:
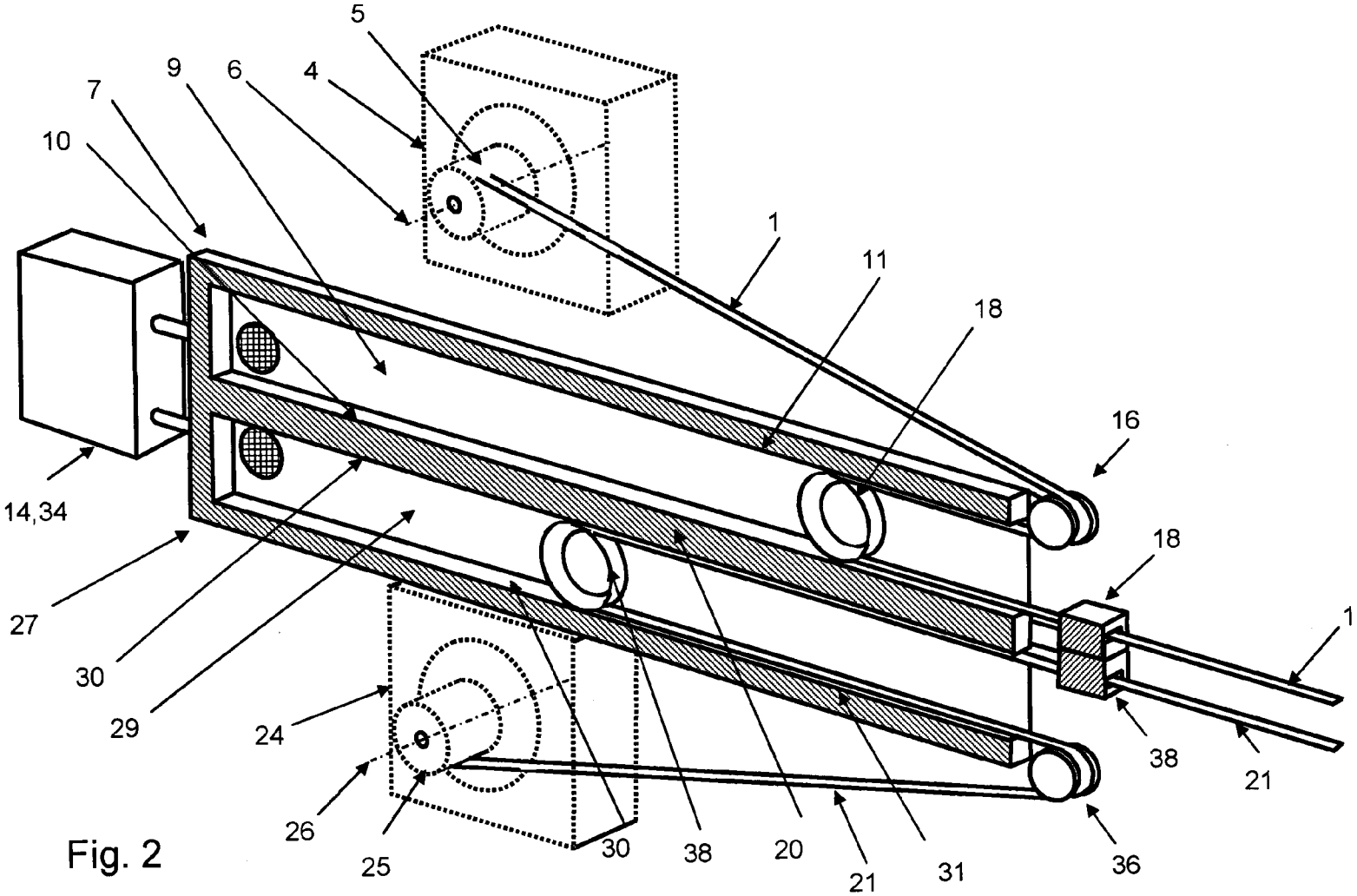
FIG. 2 Perspective view of the illustration of FIG. 1.

The FIGS. 1 and 2 show an embodiment of the device according to the invention for the intermediate storage of two band-like weft materials 1, 21 for a weaving machine 3.

The first band-like weft material 1 is supplied over a first fixedly mounted deflection roller 16, which operates as a deflection element, to a shaft-like first storage container 7 with an opening 8 at one shaft end. As usual in the state of the art, in that regard the first weft material 1 is drawn-off or unwound from a first supply bobbin 5, which is rotatably arranged about a rotation axis 6. With the aid of a first drive arrangement 4, the first supply bobbin 5 can be driven about its rotation axis 6 in a known way and manner. In that regard, the regulation or control of the drive arrangement 4 is carried out with the aid of a controller that is not shown.

In the inner space 9 of the first storage container 7, the first weft material 1 forms a U-shaped loop 12, which is guided around a movable loop roller in the present example embodiment. Proceeding from this movable loop roller, the first weft material 1 is guided through the opening 8 of the first storage container 7 again to the outside in the direction toward the weaving machine 3.

The inner space 9 of the first storage container 7 is bounded by two narrow sides 10, 11, which have a spacing distance from one another, which is sufficient so that the U-shaped loop 12 can be formed therein around the movable loop roller.

In the state of the art, embodiments without a movable loop roller have also become known, in which the U-shaped loop is formed freely or loosely in the inner space. This, however, has certain disadvantages, so that no further discussion thereof will be provided here.

In the present example, the spacing distance of the two narrow sides 10, 11 is somewhat larger than the diameter of the movable loop roller. Thereby it is ensured that this movable loop roller can move in the longitudinal direction 13 of the storage container 7.

The movable loop roller is so wide, so that it can take-up and deflect the U-shaped loop 12 of the first band-like weft material 1 in its entire width. In order to also ensure a lateral guidance of the band-like weft material 1, in the present example the movable loop roller is additionally equipped with flange borders or edge members 18 for guiding the two side edges of the band-like weft material 1. The width of the inner space 9 is somewhat larger than the width of the movable loop roller. The two sides of the inner space 9, which bound or limit the width of the inner space 9, are closed by lids or covers. This is necessary, so that a reduced pressure can be built-up in the inner space 9, through which a tensile force 15 is exerted on the weft material 1 in the storage container 7.

In an alternative, non-illustrated embodiment of the device, in which the tensile force is exerted by a spring arrangement and not by a reduced pressure, the lateral covers may possibly be omitted.

In the present example embodiment a reduced pressure is produced in the inner space 9 of the storage container 7 by a reduced pressure or vacuum device 14 in the form of a vacuum pump. For that, the reduced pressure or vacuum device 14 is connected via a line and a suction opening with the inner space 9. The suction opening is presently arranged at the end of the shaft-like storage container 7, which is oriented away from the opening 8 for the weft material 1; it is closed with a sieve-like mesh or screen.

By the reduced pressure, the weft material 1 with the movable loop roller is sucked away from the opening 8 into the first storage container 7; a tensile force 15 is exerted on the weft material.

It is usual to control the drive arrangement 4 for the first supply bobbin 5 so that the movable loop roller can only be sucked in to a certain position. This position is determined by corresponding sensors on the storage container 7 and is provided further to the controller of the first drive arrangement 4 in a known way and manner. During the drawing-off of the weft material 1 out of the storage container 7 by the weft insertion element 43 of the weaving machine 3, the movable loop roller is pulled in the direction toward the opening 8 of the storage container 7, and thereafter is again brought into the original position in the storage container 7 by the reduced pressure and by a corresponding actuation of the supply bobbin 5. Such apparatuses and the methods for their control are known to the person skilled in the art and therefore do not need to be further explained here.

In the illustrated example embodiment of the FIGS. 1 and 2, a second storage container 27, a fixedly mounted second deflection roller 36 and a movable loop roller are present. The second weft material 21 is guided analogously to the first weft material 1, so that it forms a U-shaped loop 32 around the movable loop roller and is guided through the opening 28 of the second storage container 27 again to the outside in the direction toward the weaving machine 3. Analogously to the first weft material 1, thereby a second supply bobbin 25 is present, from which a second band-like weft material 21 is drawn-off or unwound. The second supply bobbin 25 is then rotatably arranged about a rotation axis 26, and with the aid of a second drive apparatus 24 the second supply bobbin 25 can be driven about this rotation axis 26 in a known way and manner. In that regard, the drive similarly is achieved with the aid of a non-illustrated controller, which is connected with the controller for the first drive arrangement 4 of the first supply bobbin 5 in a signal transmitting manner.

Analogously to the inner space 9 of the first storage container 7, the inner space 29 of the second storage container 27 is bounded by two narrow sides 30, 31 and two lids or covers, of which the spacing distances are oriented or adapted to the dimensions of the U-shaped loop 32 or of the movable loop roller.

The dimensions of the second movable loop roller are selected with reference to the second weft material 21 with consideration of the same aspects as for the first weft material 1 in connection with the first movable loop roller. Analogously to the flange borders or edge members 18 of the first loop roller, flange borders or edge members 38 are applied to the second loop roller.

In the second storage container 27, a tensile force 35 is exerted onto the second band-like weft material 21. In the present case, this is achieved by the same reduced pressure arrangement 14 which also serves for the reduced pressure in the first storage container 7. By a non-illustrated switch-over arrangement, the reduced pressure arrangement 14 can be brought into pressure-transmitting connection selectively with the suction opening of the first or of the second storage container 7, 27 or simultaneously with both suction openings. Of course it is also conceivable to provide a separate second reduced pressure arrangement 34 for the second storage container 7. Through the reduced pressure, the second weft material 21 with the movable loop roller is also sucked away from the opening 28 into the second storage container 27.

The position control of the second U-shaped loop 32 or of the second movable loop roller during the drawing-off of the second weft material 21 by the weaving machine 3 is achieved analogously to the position control in the first storage container 7 with the aid of corresponding non-illustrated sensors on the second storage container 27 as well as by the controller of the drive arrangement 24 for the second supply bobbin 25.

The FIGS. 1 and 2 show that the two storage containers 7 and 27 are arranged so that the two inner spaces 9, 29 respectively face or orient one of their two narrow sides 10, 30 toward one another.

In the present example embodiment, the device is equipped with a separating wall 20 between the two storage containers 7, 27. This separating wall 20 forms, with two of its longitudinal sides, the two narrow sides 10, 30 which respectively bound or limit one of the two inner spaces 9, 29 of the storage containers 7, 27. The narrow sides 10, 11, 30, 31 extend in planes that are parallel to one another. The two deflection elements 16, 36, which are presently embodied as deflection rollers fixedly mounted on the respective storage container 7, 27, are arranged so that the respective weft material 1, 21 is supplied to the associated storage container 7, 27, with respect to the narrow sides 10, 11, 30, 31, in an area or region 17, 37 of the applicable inner space 9, 29, which respectively lies closer to that narrow side 11, 31 that is oriented or faces away from the respective other storage container 7, 27. In the present example, the associated supply bobbins 5, 25 and drive arrangements 4, 24 are also arranged on the side of the respective storage container 7, 27 that is oriented or faces away from the respective other storage container 7, 27. As already explained above, however, other positions of the supply bobbins 5, 25, are also conceivable. In the present example, a mirror image arrangement of the storage containers 7, 27 with their inner spaces 9, 29 as well as of the supply bobbins 5, 25 and deflection elements 16, 36 arises, whereby the planes in which the narrow sides 10, 11, 30, 31 of the inner spaces 9, 29 extend, lie between the rotational axes 6, 26 of the two supply bobbins 5, 25. In that regard it is advantageous if these two rotational axes 6, 26 extend parallel to the planes of the narrow sides 10, 11, 30, 31 of the inner spaces 9, 29, so that no twisting of the weft material 1, 21 can arise.

The device comprises a center line 41 or mirror line, which extends in the longitudinal direction 13, 33, of the storage container 7, 27 in the middle or center between the two narrow sides 10, 30, which are oriented toward one another, of the inner spaces 9, 29. In the present example embodiment, this center line 41 lies within the separating wall 20 between the two inner spaces 9, 29 at half the width of the supplied band-like weft material 1, 21 or at half the width of the two inner spaces 9, 29. The described mirror image arrangement ensures that both weft materials 1, 21 can be guided in the direction toward a weaving machine 3 without significant further deflections. An especially compact embodiment arises by the integration of the two storage containers 7, 27 in one housing with one common separating wall 20 and with an arrangement of the openings 8, 28 for the weft material 1, 21 in one plane at one end of the shaft-like storage containers 7, 27 (see FIG. 3).

Figure 3:
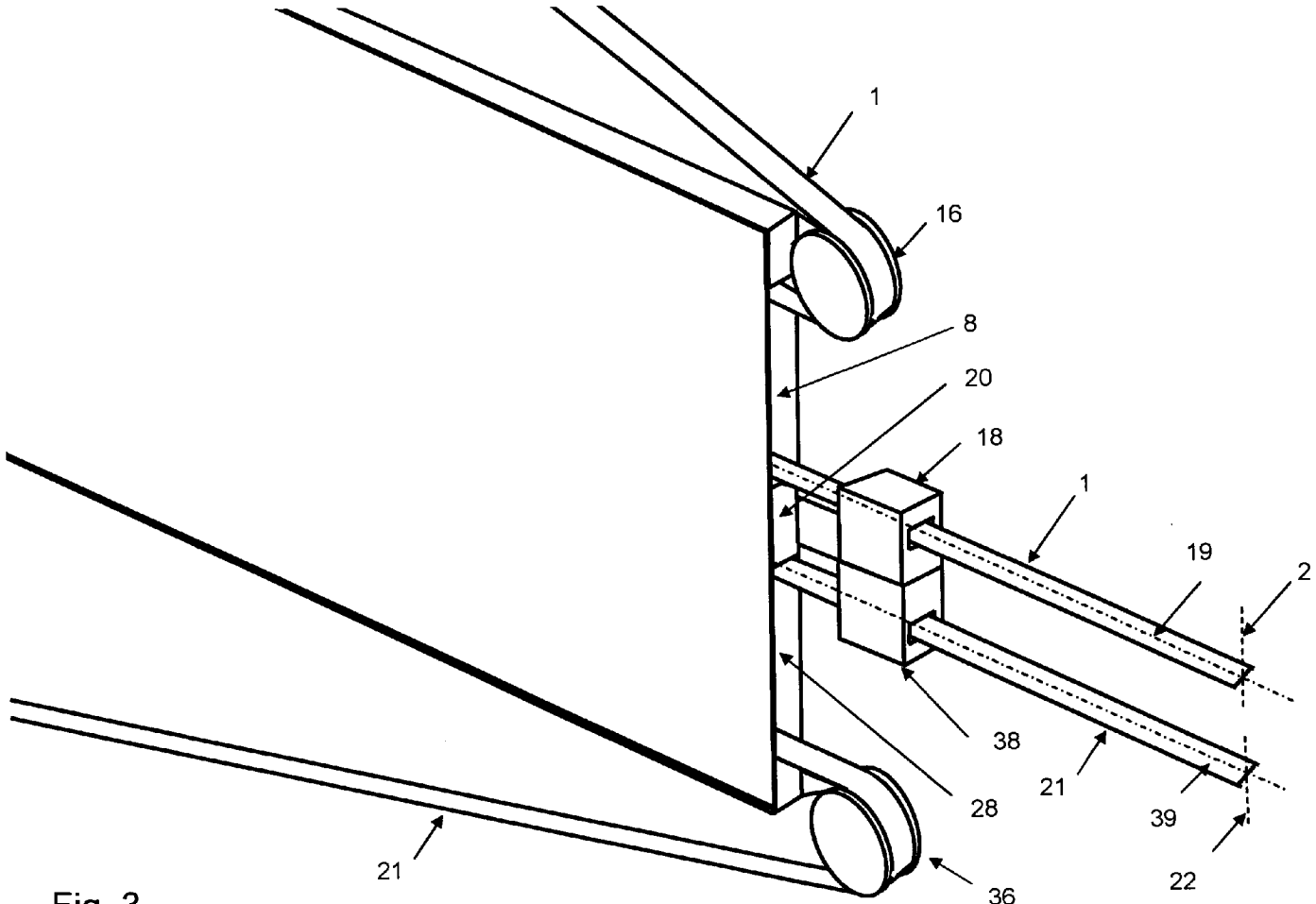
FIG. 3 Enlarged partial view of the embodiment according to FIG. 1 in a perspective view.
Figure 4:
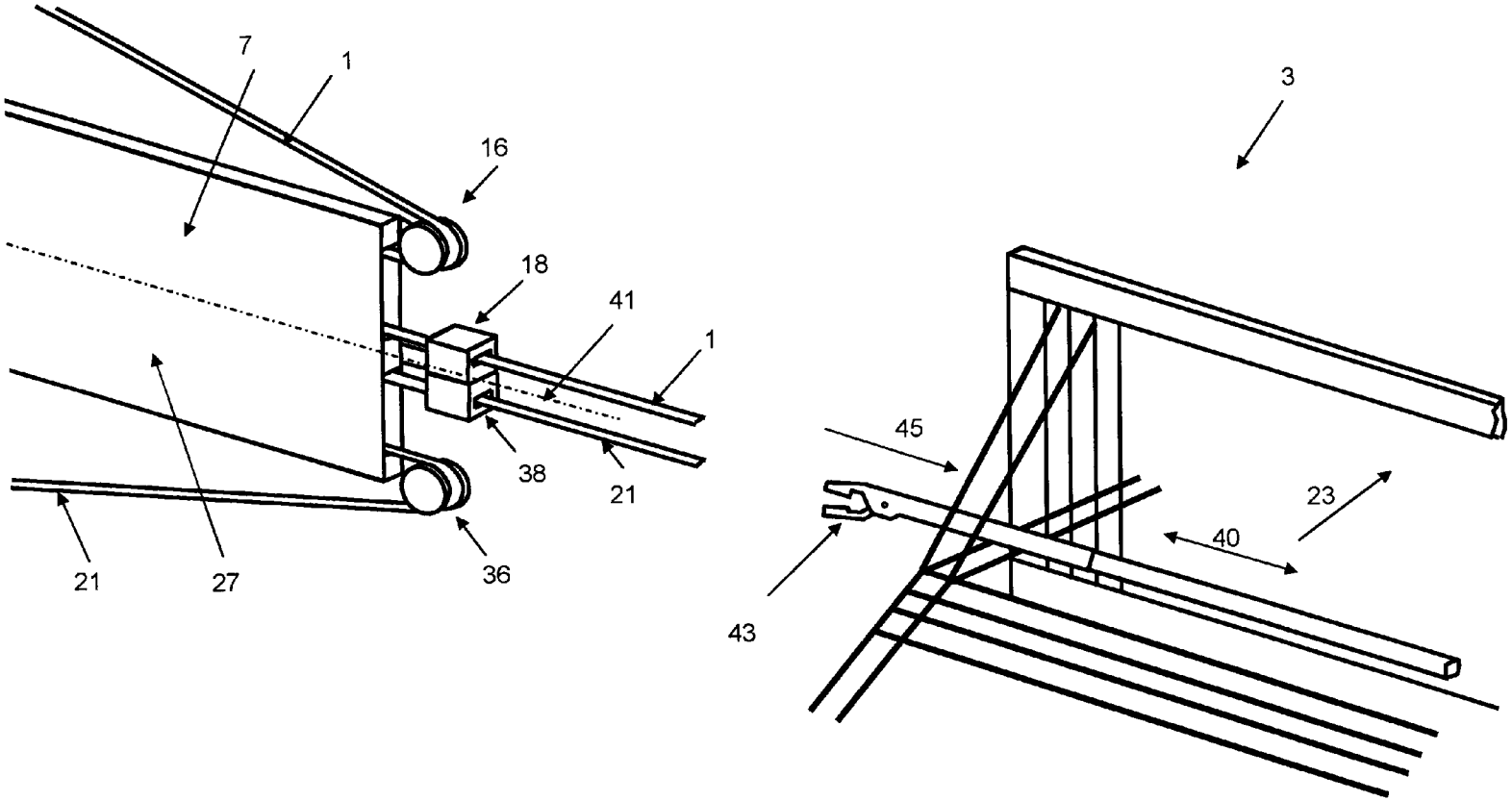
FIG. 4 Schematic illustration of the embodiment of FIG. 2 in connection with a weaving machine.

In the present example embodiment, the deflection-free supply of the weft material 1, 21 is still further supported in that the two weft materials 1, 21 are guided in such a manner so that their surfaces 19, 39 extend parallel to one another and over one another (FIG. 3). In that regard, "over one another" refers to an arrangement of the device on a weaving machine 3 in which the warp and weft threads extend horizontally at right angles to one another. In that regard, the two storage containers 7, 27 lie vertically one above another, and similarly the two weft materials 1, 21. The width of the band-like weft material 1, 21 thereby generally extends in the warp direction 23 (FIG. 4). Then the rotation axes 6, 26 of the two supply bobbins 5, 25 also are oriented in this direction.

However, the device is also utilizable on weaving machines in which the warp threads extend vertically and the weft threads extend horizontally. This arrangement is not illustrated in figures here. In such a case, the width of the weft material similarly extends in the direction of the warp threads, thus vertically. Accordingly, the rotation axes of the two supply bobbins also extend most suitably vertically in this case, and the storage containers are arranged horizontally next to one another.

FIG. 3 makes clear that the two weft materials 1, 21, while running through the device according to the FIGS. 1 and 2, are guided in such a manner so that a symmetry line 2, which extends at half the width of the first weft material 1 perpendicular to its surface 19, lies in a plane with the symmetry line 22, which extends at half the width of the second weft material 21 perpendicular to its surface 39. This type of the parallel symmetrical guidance is advantageous especially at the outlet of the storage containers 7, 27 in the direction toward the weaving machine 3, so that little twisting or deflection of the weft materials 1, 21 takes place on the path to the weaving machine 3.

The guidance of the two weft materials 1, 21 is achieved for this purpose by guide elements 18, 38 on the device, which guide the band-like weft material 1, 21 in the direction of its width and/or in the direction of its thickness.

In the present example, for this purpose separate guide elements 18, 38 are arranged on the two storage containers 7, 27 in the area of the openings 8, 28 for the respective weft material 1, 21. These guide elements 18, 38 are arranged so that the described type of the guidance is ensured. However, this guidance can also be achieved by corresponding embodiment of the deflection elements 16, 36 and/or by borders or edge members 18, 38 on the movable loop rollers. In order to be able to guide various different widths of weft materials 1, 21, and in order to be able to compensate tolerances of the components, it is further advantageous if the guide elements 18, 38 are adjustable so that the above described type of guidance can be optimized.

In that regard, the mounting or the adjustment of the guide elements 18, 38 is the most advantageous in such a manner so that the respective weft material 1, 21 is removed and guided out of the associated storage container 7, 27 with respect to the narrow sides 10, 11, 30, 31 out of an area or region of the applicable inner space 9, 29 that respectively lies closer to that narrow side 10, 30 that is respectively oriented or faces toward the other storage container 7, 27.

In a weaving machine 3 that is to process band-like weft material 1, 21, it is most advantageous if the device according to the example embodiment described here is arranged in the manner so that the tensile forces 15, 35 that act on the weft material 1, 21, and therewith the longitudinal directions 13, 33 of the storage containers 7, 27, extend parallel to the weft insertion direction 40 of the weaving machine 3.

FIG. 4 shows a gripper as a weft insertion element 43, which is slidingly pushed alternately back and forth in the weft direction 40 through the loom shed formed by the warp threads of the weaving machine 3. In that regard, the gripper grasps the weft material 1, 21 on one side of the weaving machine 3 and pulls it behind itself in the direction toward the inlet of the loom shed 45 and then therethrough. The weft thread clamp of the gripper is opened and closed during the grasping of the weft material 1, 21. During the weft insertion, the weft material 1, 21 is held between the clamping surfaces of the weft thread clamp. Such gripper weaving machines are known in the state of the art and are therefore not further explained here.

Figure 5:
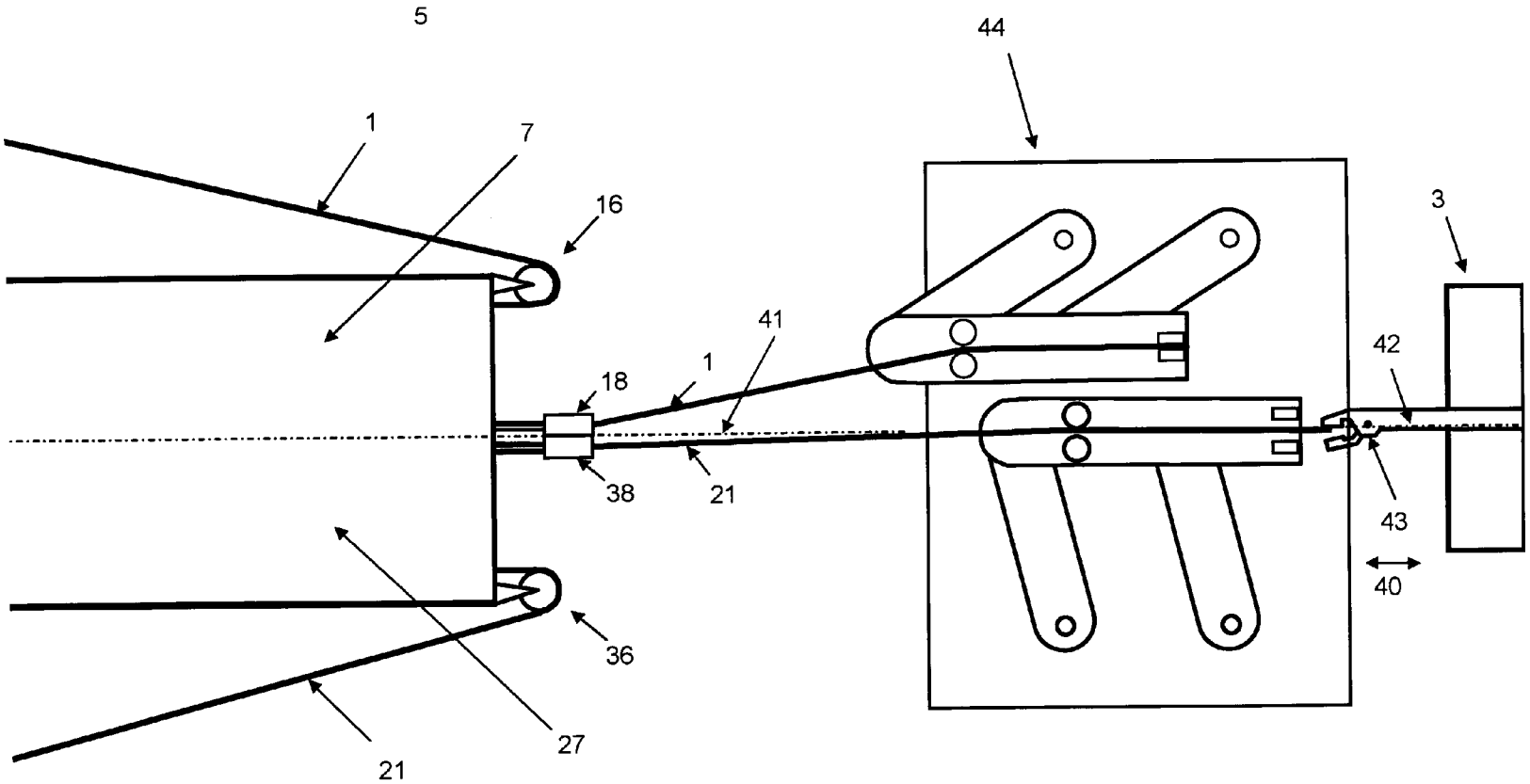
FIG. 5 Side view of the embodiment of FIG. 1 in connection with the weaving machine and a selection device.

FIG. 5 shows an arrangement according to FIG. 4, in which the center line 41 extends between the two inner spaces 9, 29 in extension of the movement line 42 of the weft insertion element 43 of the weaving machine 3. In that regard, the movement line 42 of the weft insertion element 43 is presently regarded to be the line on which the clamp surfaces of the closed weft thread clamp of the weft insertion element 43 are guided through the loom shed. In practice, due to tolerances, there will be larger or smaller deviations from a precise correspondence of the center line 41 and the extension of the movement line 42. However, the more exact that this arrangement is achieved, the less deflection is necessary while supplying the two weft materials 1, 21 to the weaving machine 3.

FIG. 5 also still shows a further advantageous embodiment with a selection device or apparatus 44 for the respective weft material 1, 21 that is to be inserted. Respectively one of the two band-like weft materials 1, 21 is held by the two clamps on the two coupling arms of the selection device 44 and is alternately supplied to the weft thread clamp of the weft insertion element 43. Such a selection device 44 and its manner of operation are shown, for example, by the DE 10 2009 036 589 A1.

The invention claimed is:

1. Apparatus for the intermediate storage of a first and a second band-like weft material (1, 21) for a weaving machine (3), with a first storage container (7) with an opening (8) for the first weft material (1) and with an inner space (9) that is bounded by two narrow sides (10, 11) in such a manner so that a U-shaped loop (12) of the first weft material (1) can be formed between these narrow sides (10, 11), whereby these two narrow sides (10, 11) extend in a longitudinal direction (13) of the first storage container (7) and in the direction of the width of the first weft material (1), as well as with means (14) for the application of a first tensile force (15) onto the first weft material (1), whereby this first tensile force (15) is directed in the longitudinal direction (13) of the first storage container (7) inwardly away from the opening (8) for the first weft material (1), as well as with a first deflection element (16) that is arranged in such a manner so that the first weft material (1) can be supplied over the first deflection element (16) through the opening (8) for the first weft material (1) to the inner space (9) of the first storage container (7), characterized in that a second storage container (27) with an opening (28) for the second weft material (21) and with an inner space (29) is present, whereby the inner space (29) is bounded in such a manner by two narrow sides (30, 31) so that a U-shaped loop (32) of the second weft material (21) can be formed between these narrow sides (30, 31), whereby these two narrow sides (30, 31) extend in a longitudinal direction (33) of the second storage container (27) and in the direction of the width of the second weft material (21), as well as that means (34) for the application of a second tensile force (35) onto the second weft material (21) are present, whereby this second tensile force (35) is directed in the longitudinal direction (33) of the second storage container (27) inwardly away from the opening (28) for the second weft material (21), as well as with a second deflection element (36) that is arranged in such a manner so that the second weft material (21) can be supplied over the second deflection element (36) through the opening (28) for the second weft material (21) to the inner space (29) of the second storage container (27), and in that both storage containers (7, 27) are arranged in such a manner so that the two weft materials (1, 21) can be supplied from the same direction through the respective openings (8, 28) to the storage containers (7, 27), whereby the inner spaces (9, 29) of the two storage containers (7, 27) respectively orient one of the narrow sides toward one another and whereby the narrow sides (10, 11, 30, 31) of the two inner spaces (9, 29) extend parallel to one another in the direction of their width extension, and in that the two deflection elements (16, 36) are respectively arranged in such a manner so that the respective weft material (1, 21) can be supplied through the opening (8, 28) for this weft material (1, 21) to the inner space (9, 29) of the respective storage container (7, 27) in a region (17, 37) which, with respect to the respective two narrow sides (10, 11, 30, 31), lies closer to that narrow side (11, 31) of this inner space (9, 29) that is not oriented toward the inner space (9, 29) of the respective other storage container (7, 27).

2. Apparatus according to claim 1 with guide elements (18, 38) for the weft material (1, 21) that are arranged or adjustable in such a manner so that the respective weft material (1, 21) can be removed out of the associated storage container (7, 27) with respect to the narrow sides (10, 11, 30, 31) of the applicable inner space (9, 29) out of a region that respectively lies closer to that narrow side (10, 30) that is oriented toward the respective other storage container (7, 27).

3. Apparatus according to claim 1, with guide elements (18, 38) that are arranged in such manner and/or are adjustable in such a manner so that the two weft materials (1, 21) extend in a region, in which they are removed out of the apparatus, in such a manner so that a symmetry line (2), which extends at half the width of the first weft material (1) perpendicularly to its surface (19), lies in a plane with a symmetry line (22), which extends at half the width of the second weft material (21) perpendicularly to its surface (39).

4. Apparatus according to claim 1, in which both storage containers (7, 27) are arranged in such a manner so that the narrow sides (10, 11, 30, 31) of the two inner spaces (9, 29) lie in planes extending parallel to one another.

5. Apparatus according to claim 1, in which a separating wall (20) is present between the two inner spaces (9, 29), which separating wall is common to both storage containers (7, 27).

6. Weaving machine (3) with an apparatus according to claim 1, in which the two storage containers (7, 27) are arranged in such a manner so that the two tensile forces (15, 35) extend parallel to a weft direction (40) of the weaving machine (3).

7. Weaving machine (3) according to claim 6 in which the two inner spaces (9, 29) of the storage containers (7, 27) are arranged symmetrically to a center line (41) that extends parallel to the longitudinal direction (13, 33) of the storage containers (7, 27), and wherein this center line (41) extends in the extension of the movement line (42) of a weft insertion element (43) of the weaving machine (3).

8. Weaving machine (3) according to claim 7 with a selection device (44), which is arranged between the openings (8, 28) for the two weft materials (1, 21) and the inlet of a loom shed (45) of the weaving machine (3), and with which selectively the first (1) or the second weft material (21) is selectable and can be supplied to the weft insertion element (43) of the weaving machine (3).

* * * * *